United States Patent [19]

Baker

[11] 4,079,245

[45] Mar. 14, 1978

[54] LAMP SHADE

[76] Inventor: John Geoffrey Baker, 127 Pleasant Ave., Willowdale, Ontario, Canada, M2M IM2

[21] Appl. No.: 745,653

[22] Filed: Nov. 29, 1976

[51] Int. Cl.[2] ..... F21V 1/00

[52] U.S. Cl. ..... 362/355; 362/360; 362/358

[58] Field of Search ..... 240/108 R, 108 A, 108 B, 240/109, 110, 132, 133, 147, 128, 140, 142; 428/7, 8, 9, 12; 46/21, 31, 26, 39

[56] References Cited

U.S. PATENT DOCUMENTS

| | | | |
|---|---|---|---|
| 636,615 | 11/1899 | Ball | 240/108 R |
| 1,050,407 | 1/1913 | Verrette | 220/7 |
| 2,395,542 | 2/1946 | Fordon | 220/7 |
| 2,829,245 | 4/1958 | Levings | 240/108 R |

FOREIGN PATENT DOCUMENTS

| | | | |
|---|---|---|---|
| 598,640 | 10/1925 | France | 240/108 |

*Primary Examiner*—Fred L. Braun
*Assistant Examiner*—Peter S. Wong
*Attorney, Agent, or Firm*—Fetherstonhaugh & Co.

[57] ABSTRACT

An improved lamp shade having a plurality of glass panels each having a plurality of side edges which are angularly inclined to one another to form corners therebetween, including a panel support structure consisting of a corner collar extending about the corners of each panel and connector means for interconnecting the collars to secure panels with respect to one another. The connector means consists of an elongated body disposed within a narrow passage between adjacent panels. The connector means has hook-shaped portions at either end thereof connected to adjacent corner collars of adjacent panels to connect the panels together. The elongated body of the connector means has abutting surfaces disposed at opposite sides thereof extending longitudinally thereof in a face-to-face abutting relationship with each of the adjacent side edges of the glass panels to maintain the side edges of the panels in a spaced parallel relationship. The abutting surfaces of the elongated body having a sufficient longitudinal extent to distribute loads applied thereto along a substantial length of the side edges of the glass panels thereby to prevent damage to the panels during shipping and handling.

7 Claims, 5 Drawing Figures

LAMP SHADE

This invention relates to lamp shades and lamps incorporating lamp shades.

PRIOR ART

Lamp shades made from glass panels connected to one another by means of a wire frame are known but the known shades have been hand-made and are not of high quality. These known shades have employed a wire frame consisting of collars or rings extending about the corners of the glass panels and wire arms formed with a hook portion at either end thereof for connecting adjacent collars and a body extending between the hooked ends thereof for connecting spaced apart collars to form the frame. This structure has been considered to be of little or no commercial value when manufacturing high quality glass lamp shades on a large scale as it was generally accepted that the wire frame would damage the glass panels during shipping and handling. As a result, this structure has never been used in the production of high quality glass lamp shades. In addition, this type of frame has only been used in association with glass panels which are highly coloured with the result that if the glass panels were damaged by the wire frame, the damage would not be immediately obvious.

Because of the difficulties which have been encountered in forming a lamp shade with glass panels, the vast majority of the inexpensive and moderately priced lamp shades which are presently available are made from a plastics material and not from clear or smoked glass. The plastics material which is commonly used in the manufacture of lamp shades does not have the optical transparency of plate glass and consequently plastics lamp shades are generally coloured. As a result, the only lamp shades which employ transparent plate glass panels are those which have a full metal frame for supporting the glass panels and are therefore, extremely expensive.

The aesthetic appearance of a lamp shade which does not have a full metal frame extending around each panel is adversely affected by the thickness of the edge of the panel which generally appears as a black line. This characteristic has led to the general impression in the industry that one should not attempt to manufacture a lamp shade with glass panels without providing a frame extending around the peripheral edges thereof.

SUMMARY OF INVENTION

The present invention overcomes the difficulties of the prior art described above and provides a lamp shade in which a plurality of glass panels are connected to one another by a wire frame and in which the frame is adapted to prevent damage to the glass panels during shipping and handling thereof.

According to one aspect of the present invention there is provided in a lamp shade which includes a plurality of glass panels, each having a plurality of side edges which are angularly inclined with respect to one another to form corners therebetween, the side edges of at least two of said panels being juxtaposed and forming a narrow passage therebetween, and a panel support structure which includes a corner collar extending about each corner at each end of said adjacent sides, the improvement of connector means for interconnecting said collars to secure said panels with respect to one another comprising, an elongated body disposed within said narrow passage and having means at either end thereof connected to adjacent corner collars of adjacent panels to connect said panels together, said elongated body having abutting surfaces disposed at opposite sides thereof and extending longitudinally thereof in a face-to-face abutting relationship with each of said adjacent edges of said glass panels to maintain said side edges of said panels in a spaced parallel relationship, said abutting surfaces of said elongated body having a sufficient longitudinal extent to distribute loads applied thereto along a substantial length of said side edges of said glass panels thereby to prevent damage to the panels during shipping and handling.

According to a further aspect of the present invention, there is provided a lamp shade as described above in which the juxtaposed side edges of the glass panels are chamferred.

According to a still further aspect of the present invention, there is provided a lamp shade as described above in which the glass panels are made from clear plate glass or smoked plate glass.

PREFERRED EMBODIMENT

The invention will be more clearly understood after reference to the following detailed specification read in conjunction with the drawings, wherein FIG. 1 is a pictorial view of a lamp shade according to an embodiment of the present invention;

Figure 1:
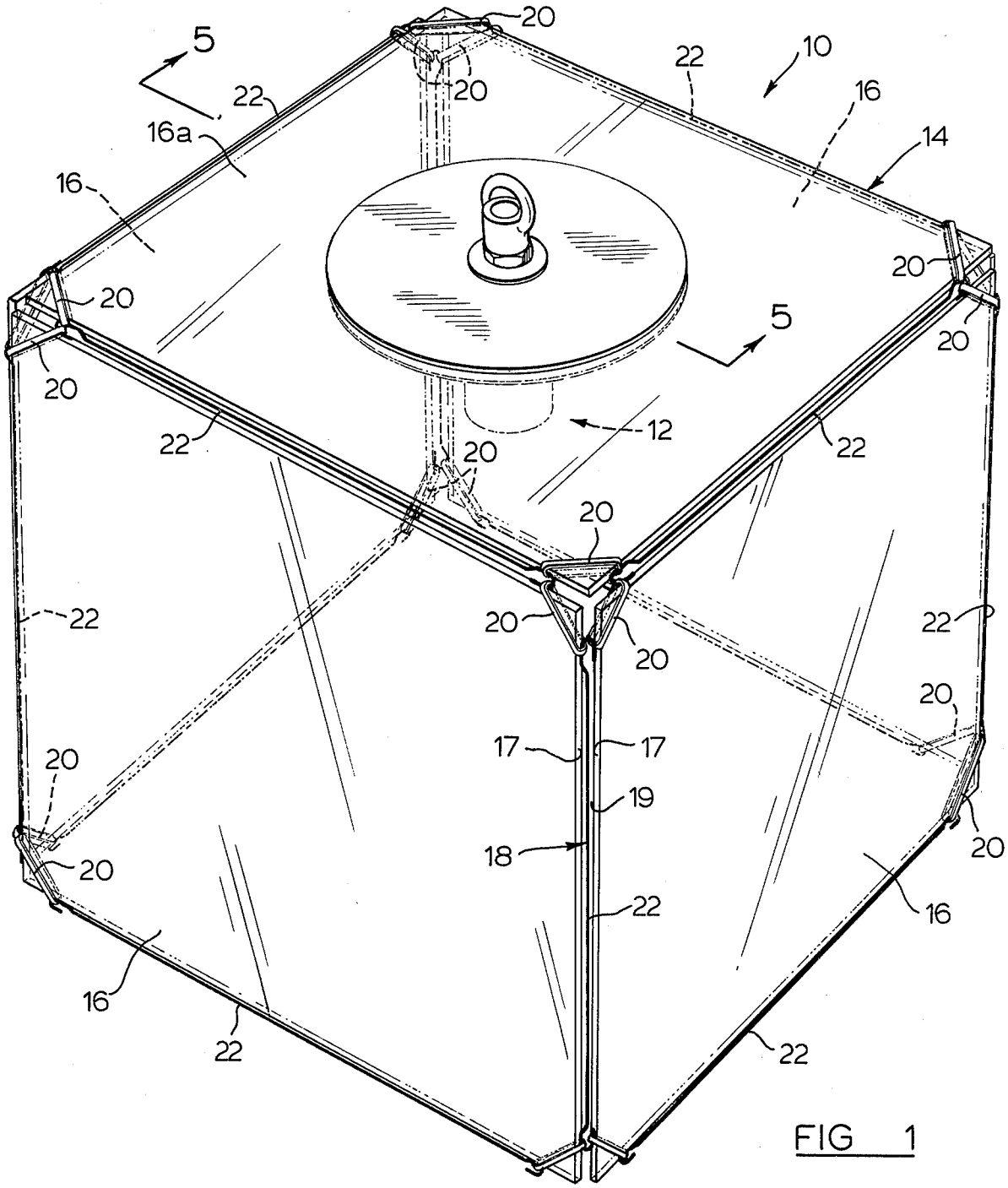

With reference to FIG. 1 of the drawings, the reference numeral 10 refers generally to a lamp according to an embodiment of the present invention. The lamp includes a lamp fixture generally identified by the reference numeral 12 and a lamp shade generally identified by the reference numeral 14.

The lamp shade consists of a plurality of glass panels ly which are preferably transparent plate glass or transparent smoked glass panels of high quality plate glass free from abrasions and inclusions. The panel 16a is a centrally located horizontally extending panel which serves to support the light fixture 12.

The panels 16 are connected to one another by a wire frame generally identified by the reference numeral 18. The frame is made up of a plurality of corner collar elements 20 and connector members 22. While the frame members may be made from any suitable material, brass is a preferred material as it enhances the appearance of the lamp shade.

Figure 2:
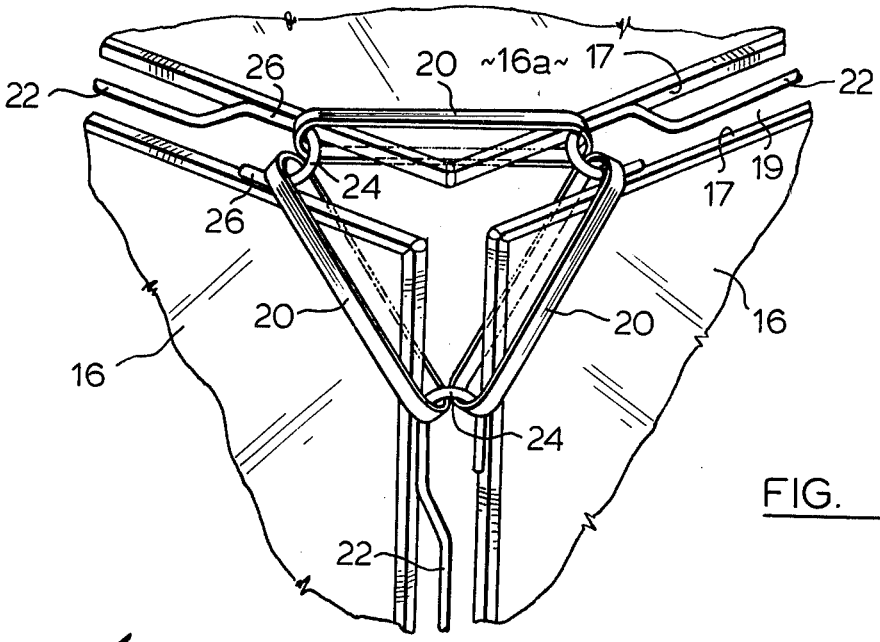
FIG. 2 is an enlarged detailed view of one end of the connector member.

In the embodiment of the invention illustrated in FIGS. 1 and 2 of the drawings, the connector member 22 consists of an elongated wire body which is folded upon itself at either end thereof to provide hook-shaped ends 24. As clearly indicated in FIG. 2, each of the hook-shaped ends 24 has oppositely disposed spaced parallel longitudinally extending portions 26. The outer surfaces of the spaced parallel portions 26 form abutting surfaces of the connector member at opposite ends thereof which serve to maintain the juxtaposed side edges 17 of the glass panels 16 in a spaced relationship with a narrow passage 19 located therebetween.

Figure 3:
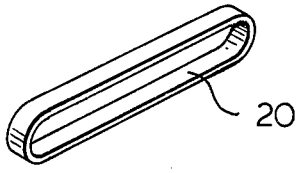
FIG. 3 is a pictorial view of a corner collar.

With reference to FIG. 3 of the drawings, it will be seen that the collars 20 are in the form of narrow metal bands arranged in a flattened ring configuration to fit freely over the corners of the panels.

Figure 4:
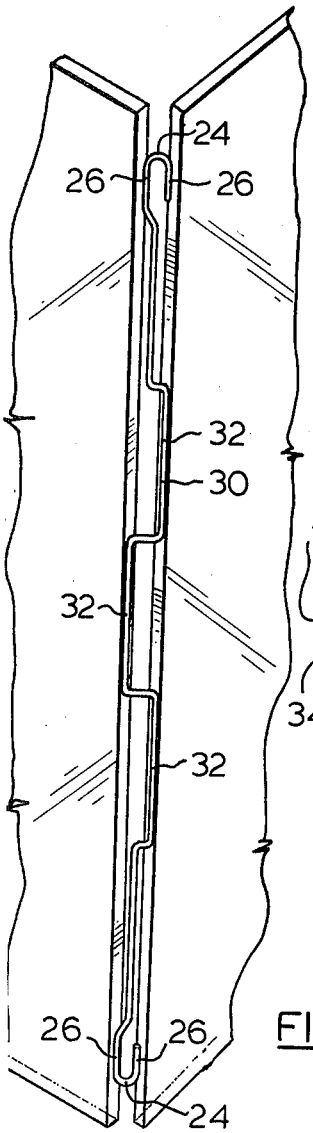
FIG. 4 is an enlarged detailed view of a connector according to a further embodiment of the invention.

A connector 30, according to a further embodiment of the present invention, is illustrated in FIG. 4. The connector 30 differs from the connectors 22 previously described in that the central body portion thereof is formed with additional longitudinally extending portions 32 disposed in the longitudinal plane of the portions 26 of the hook-shaped ends 24 to provide additional abutting surfaces to distribute loads applied thereto along a substantial length of the juxtaposed side edges of the glass panels.

As shown in FIG. 1 of the drawings, adjacent glass panels have side edges 17 spaced from one another by the connector members 22 to provide a narrow passage 19 therebetween.

Figure 5:
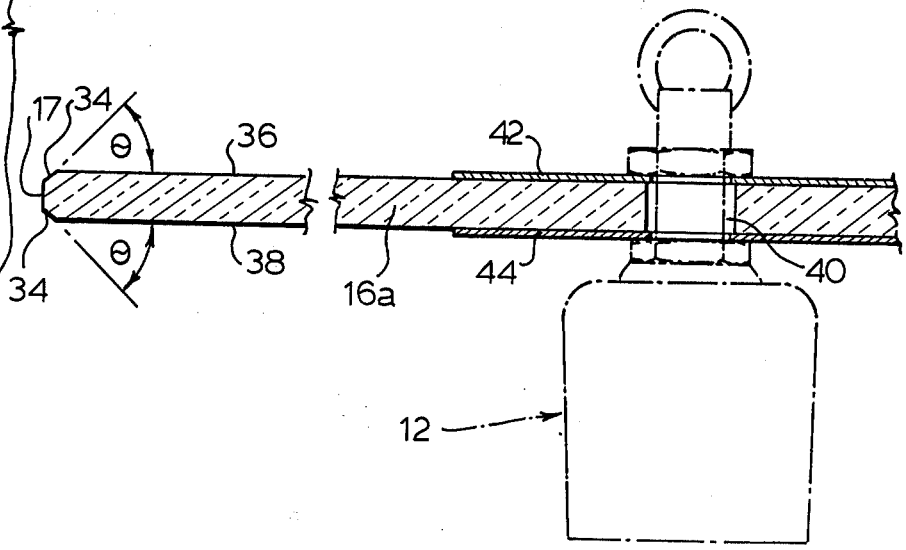
FIG. 5 is a sectional view along the line 5—5 of FIG. 1.

As shown in FIG. 5 of the drawings, the side edges 17 of the glass panels 16 are chamferred at 34 at an angle $\theta$ preferably about 45° to the plane of the upper surface 36 and lower surface 38 of the glass panel 16. This chamfer serves to further reduce the liklihood of the panels being damaged by the wire frame. The chamfer also serves to diffuse the light passing through the edge of the panel and thereby reduce the width of the "black line" formed by the edge of a glass panel and give the impression that the panels are made from a thinner plate glass than is in fact used.

The upper panel **16*a* is formed with a passage 40 opening therethrough. Upper and lower flat annular reinforcing rings 42 and 44 are adhesively bonded to the upper panel 16*a* in a face-to-face relationship to reinforce the portion of the panel 16a disposed adjacent the passage 40. The reinforcing rings 42 and 44 are preferably made from sheet metal such as brass and are bonded to the panel 16*a* by means of a suitable glass-to-metal adhesive. The external diameter of the rings 42 and 44 is preferably twice the diameter of the central passage 40 so that the load applied thereto by the light fixture 12 is distributed over a substantial area of the panel 16*a***. It has been found that this reinforcing ring structure serves to permit the lamp shade to be suspended directly from the lamp fixture. Without this ring structure, it is necessary to provide an intermediate frame structure extending between the lamp shade and the light fixture.

In the assembly of the lamp shade the connector members are formed with a complete hook shaped hand at one end thereof and a partial hook at the other end thereof in the partial hook configuration, the free arm 26 is aligned with the transverse arm 24. The fully formed hook end is hooked around at least one and at generally two adjacent collars to connect them together and the other end is hooked through at least one and generally two collars and the outer arm portion 26 is manually folded over to assume its position extending parallel to the opposite arm 26. As shown in FIG. 1 of the drawings, each set of collars is connected by a connecting member to an adjacent collar and the connecting members also serve to connect adjacent collars of adjacent panels to one another.

From the foregoing, it will be apparent that the present invention provides a simple and inexpensive lamp shade and lamp fixture incorporating a lamp shade in which the glass panels are connected to one another by means of a metal frame which is adapted to prevent damage to the frame during shipping and handling and use of the lamp shade.

Various modifications of the preferred embodiment described above will be apparent to those skilled in the art without departing from the scope of the invention. For example, the various panels of the lamp shade may be arranged in any required configuration and the invention is not limited to a lamp shade having a cubic configuration.

In addition, the edges of the panels which are not juxtaposed edges of an adjacent panel, may be scalloped or otherwise shaped to secure a collar thereon without requiring a connector member extending therebetween.

What I claim as my invention is:

1. In a lamp shade which includes a plurality of glass panels, each having a plurality of side edges which are angularly inclined to one another to form corners therebetween, the side edges of at least two of said panels being juxtaposed and forming a narrow passage therebetween, and a panel support structure which includes a corner collar extending about each corner at each of said adjacent sides, the improvement of connector means for interconnecting said collars to secure said panels with respect to one another comprising, an elongated body disposed within said narrow passage and having means at either end thereof connected to adjacent corner collars of adjacent panels to connect said panels together, said elongated body having abutting surfaces disposed at opposite sides thereof and extending longitudinally thereof in a face-to-face abutting relationship with each of said adjacent edges of said glass panels to maintain said side edges of said panels in a spaced parallel relationship, said abutting surfaces of said elongated body having a sufficient longitudinal extent to distribute loads applied thereto along a substantial length of said side edges of said glass panels thereby to prevent damage to the panels during shipping and handling.

2. A lamp shade as claimed in claim 1 wherein said connector means consists of a wire member folded upon itself to form said abutting surfaces.

3. A lamp shade as claimed in claim 1 wherein said connector means consists of a wire member folded upon itself at either end thereof to form hook-shaped end portions for connecting the corner collars as aforesaid, each of said hook-shaped portions having an arm thereof extending longitudinally thereof to form said abutting surfaces whereby said panels are held in a spaced relationship at opposite ends of said connector means.

4. A lamp consisting of a lamp shade as claimed in claim 1 wherein one of said panels is a centrally located horizontally extending flat panel having an upper surface and a lower surface, a passage opening through said centrally located panel, and substantially rigid upper and lower flat annular reinforcing rings bonded in a face-to-face relationship with respect to the upper and lower surfaces of said central panel respectively and arranged to extend radially outwardly from said central passage to a diameter which is at least twice the diameter of the central passage, and lamp fixture means mounted in said central passage and supported by said reinforcing rings.

5. A lamp shade as claimed in claim 1 wherein at least the juxtaposed side edges of said glass panels are chamferred to avoid presentation of a sharp edge to the abutting surfaces of said elongated body and to diffuse light passing therethrough whereby in use the panel gives the impression of being made from thinner glass than it is in fact made from.

6. A lamp shade as claimed in claim 1 wherein said juxtaposed panels are made from transparent plate glass.

7. A lamp shade as claimed in claim 1 wherein said juxtaposed panels are made from smoked plate glass.

* * * * *